US007946422B1

(12) United States Patent
Bjerke

(10) Patent No.: US 7,946,422 B1
(45) Date of Patent: May 24, 2011

(54) DISPENSING AND DISPOSING CONTAINER SYSTEM

(76) Inventor: Mary A. Bjerke, Fargo, ND (US)

( * ) Notice: Subject to any disclaimer, the term of this patent is extended or adjusted under 35 U.S.C. 154(b) by 222 days.

(21) Appl. No.: 12/336,621

(22) Filed: Dec. 17, 2008

Related U.S. Application Data

(60) Provisional application No. 61/007,885, filed on Dec. 18, 2007.

(51) Int. Cl.
*A45C 11/20* (2006.01)

(52) U.S. Cl. ..... 206/546; 206/549; 220/23.86; 220/23.87; 220/212; 426/115

(58) Field of Classification Search ..... 206/216, 206/217, 223, 541, 546, 549, 577, 349, 372, 206/373; 99/484, 646 C, 323; 108/25, 26; 220/23.83, 23.86, 23.87, 23.89, 212, 574; 426/115, 120
See application file for complete search history.

(56) References Cited

U.S. PATENT DOCUMENTS 2,949,951 A * 8/1960 Schoen ..... 150/110
3,219,226 A * 11/1965 Schroeder ..... 220/23.83
4,054,205 A * 10/1977 Blow et al. ..... 206/217
4,977,820 A * 12/1990 Lin ..... 99/323
5,441,163 A * 8/1995 Carrasco ..... 220/23.86
6,059,109 A * 5/2000 Stein ..... 206/373
6,398,071 B1 6/2002 Fellers
7,428,864 B2 * 9/2008 Wengrovsky ..... 99/646 C
7,673,767 B2 * 3/2010 Vovan ..... 220/212
* cited by examiner

*Primary Examiner* — Luan K Bui
(74) *Attorney, Agent, or Firm* — Jeffrey A. Proehl; Woods, Fuller, Shultz & Smith, PC

(57) ABSTRACT

A dispensing and disposing container system is disclosed that includes a primary container having an upper opening and defining a primary compartment, and with a top and a bottom. The system also includes a secondary container having an upper opening and defining a secondary compartment. The system further includes a mounting structure on the primary container that mounts the primary container on the secondary container in a first mounting mode and a second mounting mode. The first mounting mode is characterized by the primary container closing the upper opening of the secondary container and the secondary container supports the primary container. The second mounting mode is characterized by the secondary compartment of the secondary container being accessible through the upper opening of the secondary container is maintained while the primary container is supported on the secondary container.

19 Claims, 7 Drawing Sheets

DISPENSING AND DISPOSING CONTAINER SYSTEM

REFERENCE TO RELATED APPLICATIONS

This application claims the benefit of U.S. provisional patent application No. 61/007,885, filed Dec. 18, 2007, which is hereby incorporated by reference in its entirety.

BACKGROUND

1. Field

The present disclosure relates to containers and more particularly pertains to a new dispensing and disposing container system for conveniently and cleanly storing a foodstuff and residue from consuming the foodstuff.

2. Description of the Prior Art

A wide variety of container systems have been proposed and implemented for containing two or more substances separately from each other. It is believed that these container systems are generally not as easy to use as they could be made, and therefore it is believed that there is a need for a container system that is simple in construction yet easy to use.

SUMMARY

In view of the foregoing limitations in the known types of containers now present in the prior art, the present disclosure describes a new dispensing and disposing container system which may be utilized for conveniently and cleanly storing a foodstuff and residue from consuming the foodstuff.

The present disclosure relates to a dispensing and disposing container system comprising a primary container having an upper opening and defining a primary compartment, with the primary container having a top and a bottom. The system also includes a secondary container having an upper opening and defining a secondary compartment. The system further includes a mounting structure on the primary container that mounts the primary container on the secondary container in a first mounting mode and a second mounting mode. The first mounting mode is characterized by the primary container closing the upper opening of the secondary container and the secondary container supports the primary container. The second mounting mode is characterized by the secondary compartment of the secondary container being accessible through the upper opening of the secondary container is maintained while the primary container is supported on the secondary container.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
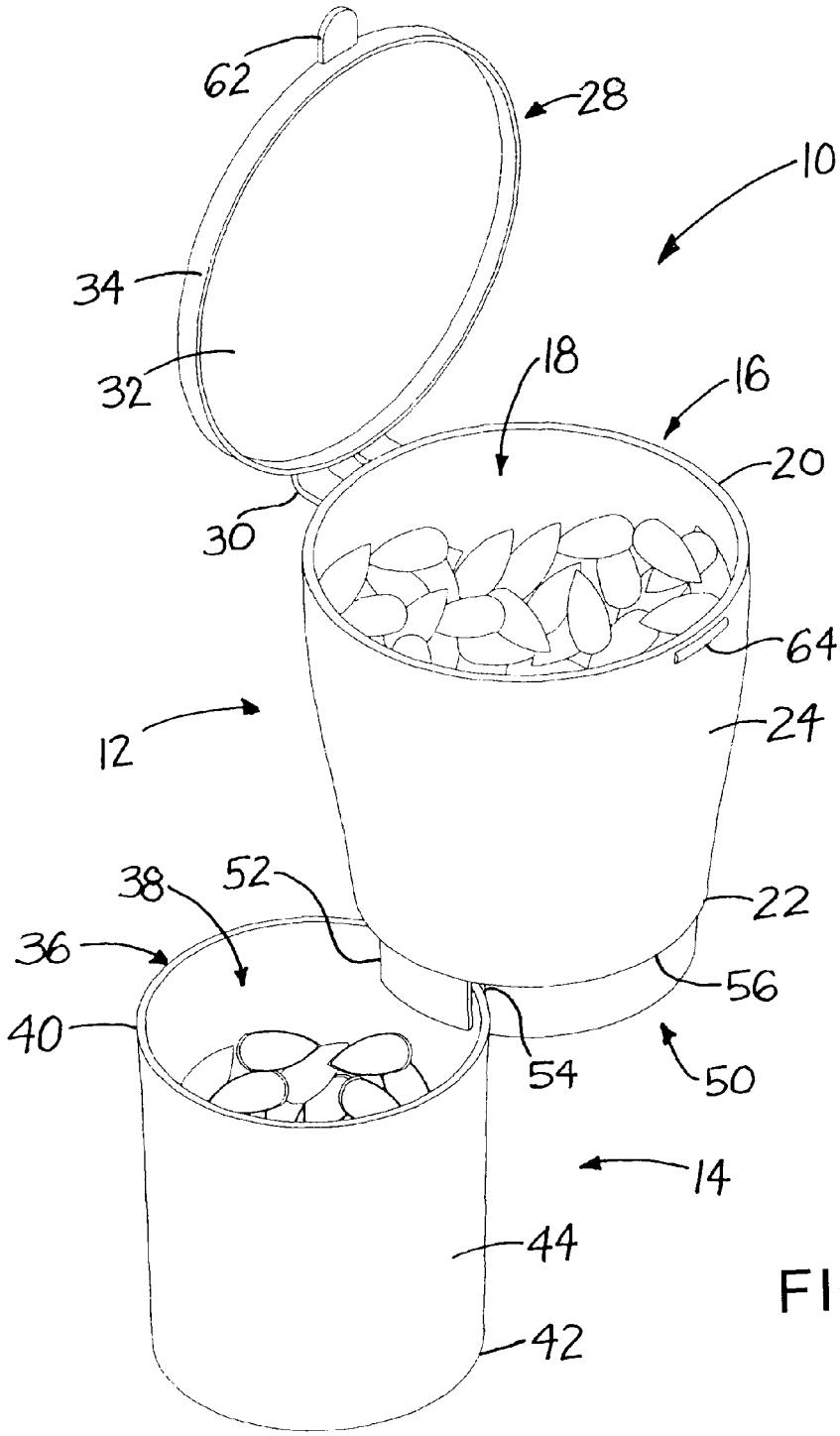
FIG. 1 is a schematic perspective view of a new dispensing and disposing container system according to the present disclosure shown in the open mounted condition.
Figure 2:
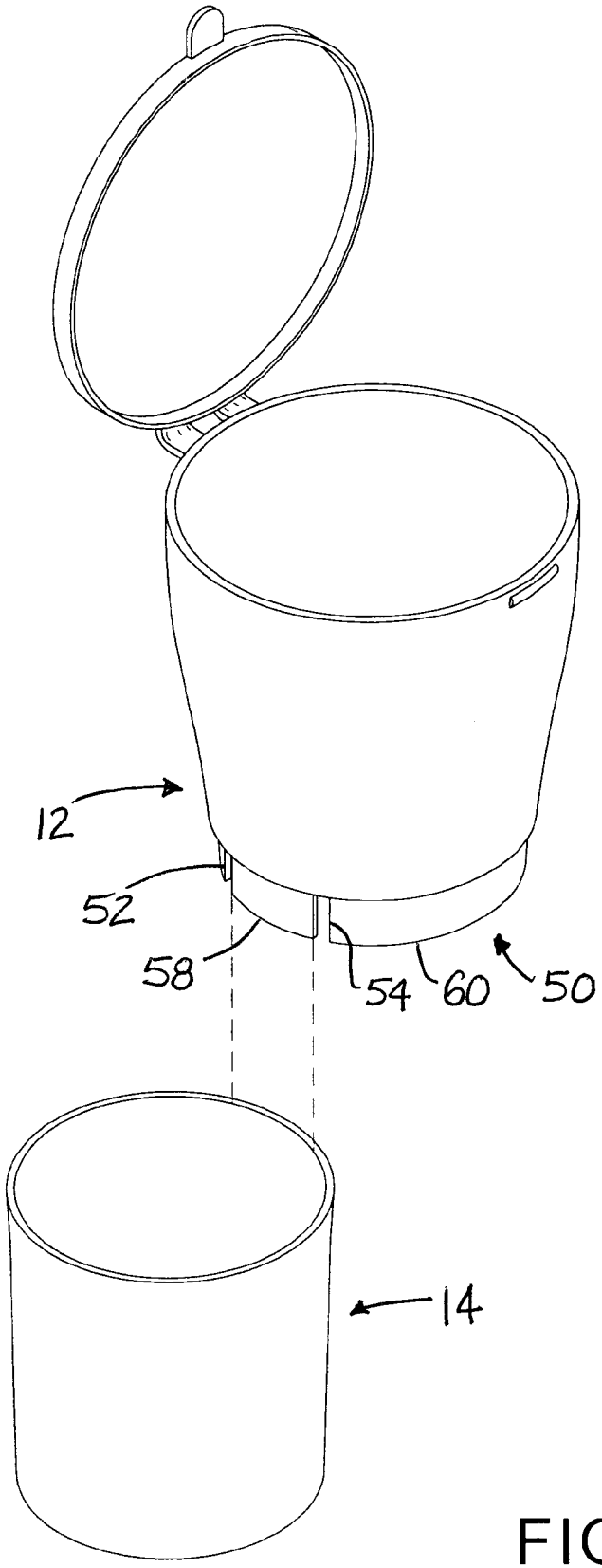
FIG. 2 is a schematic exploded perspective view of the container system, according to an illustrative embodiment.
Figure 3:
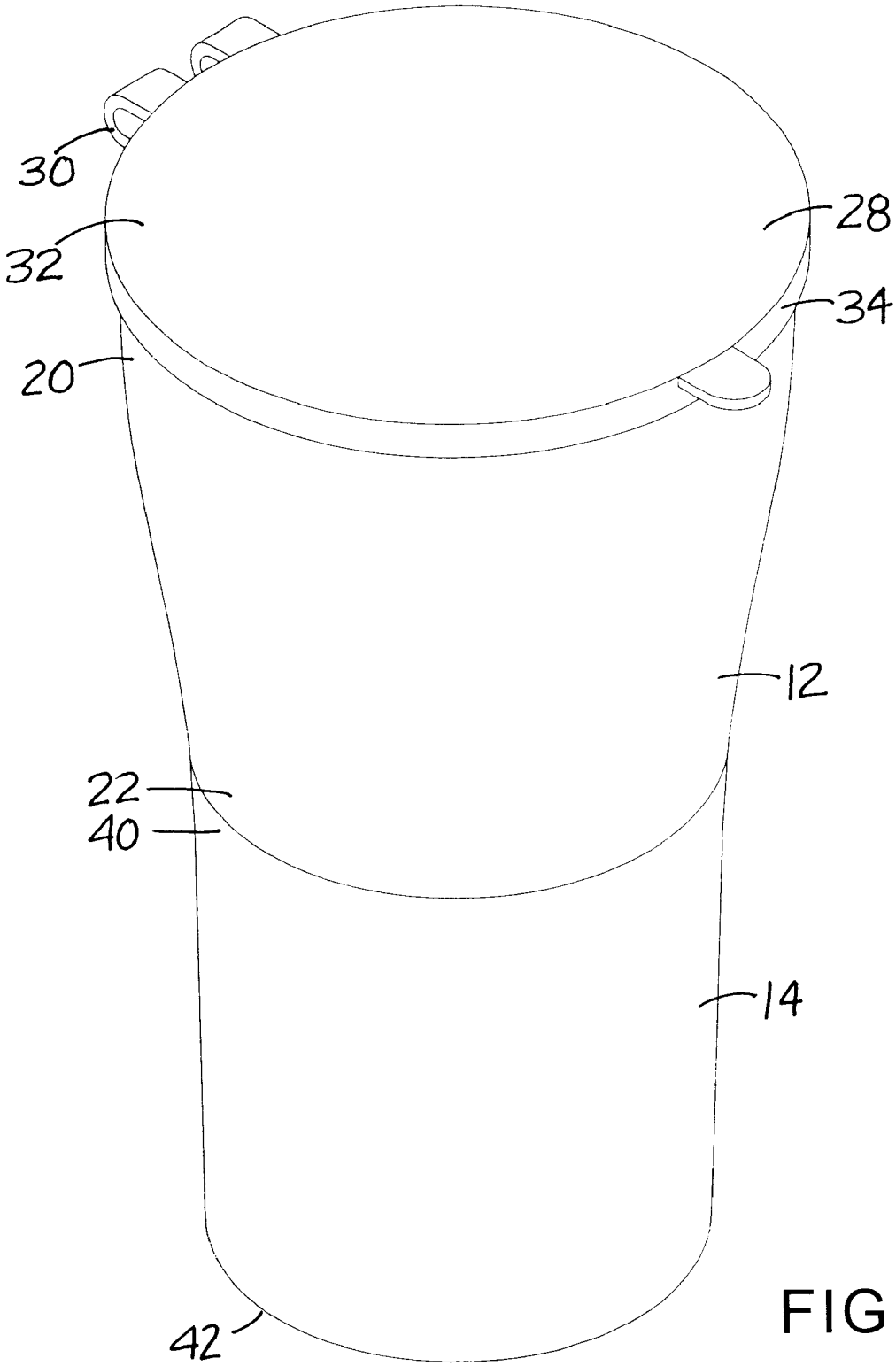
FIG. 3 is a schematic perspective view of the container system, according to an illustrative embodiment, shown in the closed mounted condition.
Figure 4:
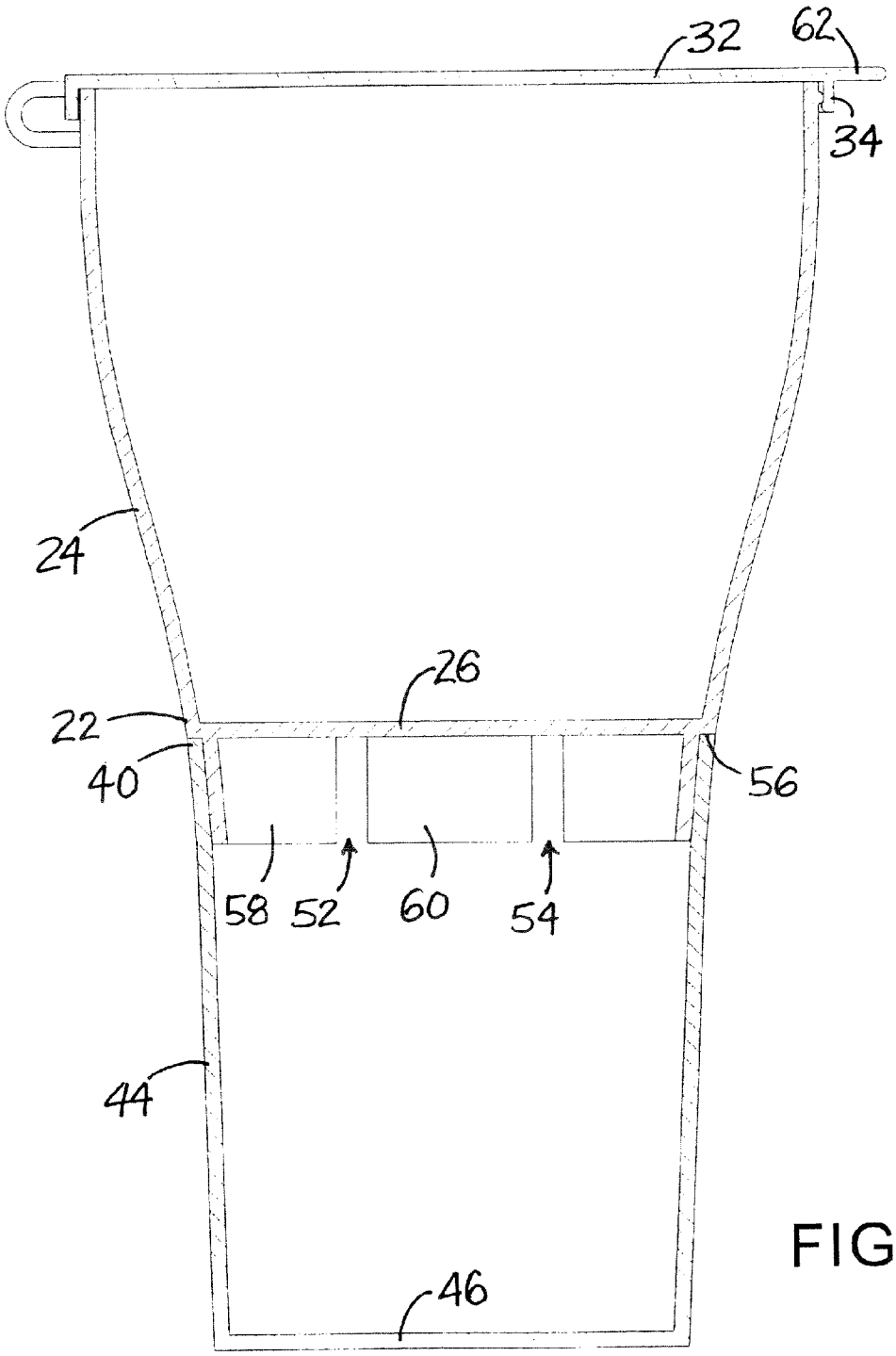
FIG. 4 is a schematic sectional view of the container system shown in the closed mounted condition.
Figure 5:
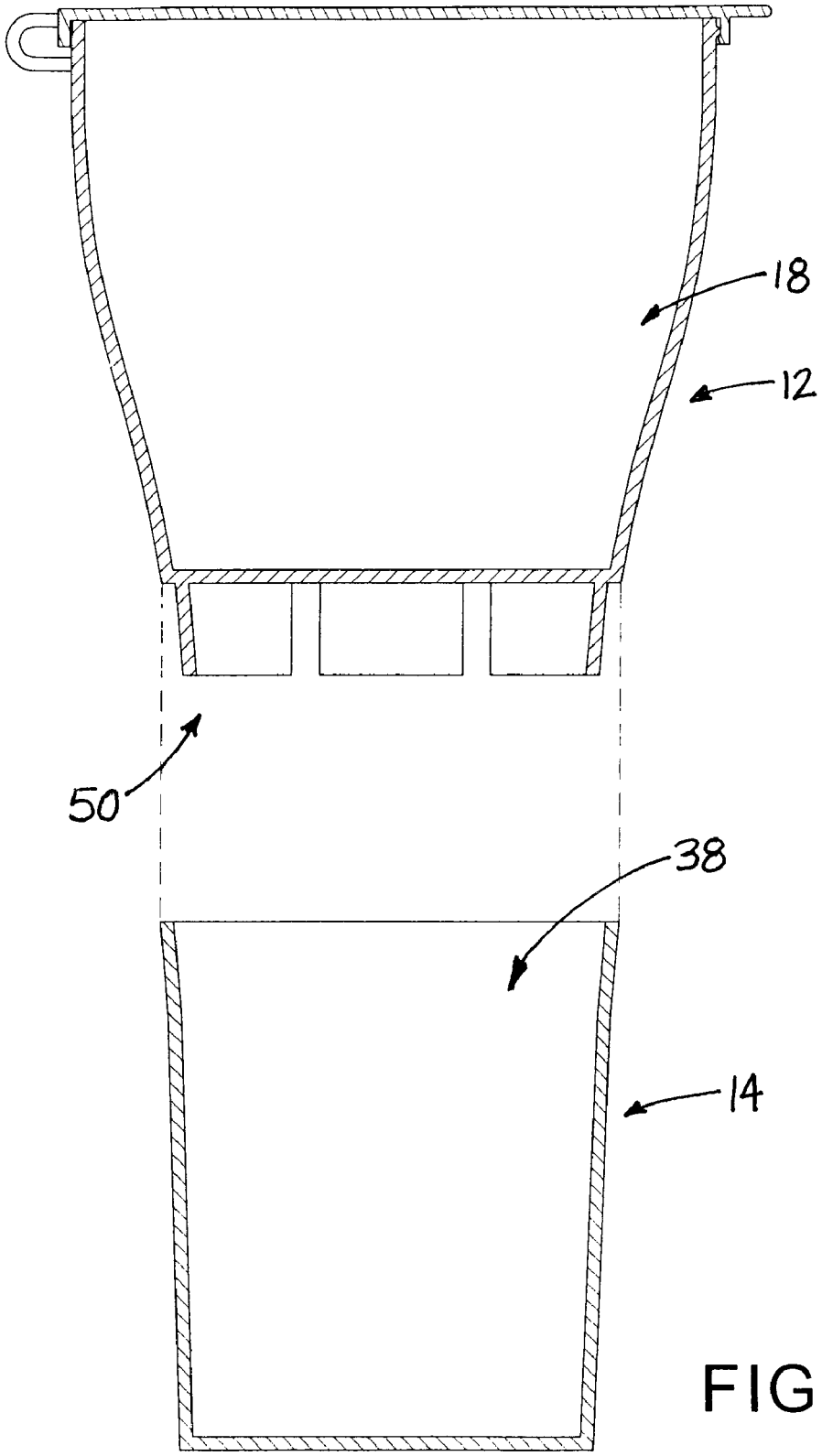
FIG. 5 is a schematic sectional view of the container system shown in an exploded condition.
Figure 6:
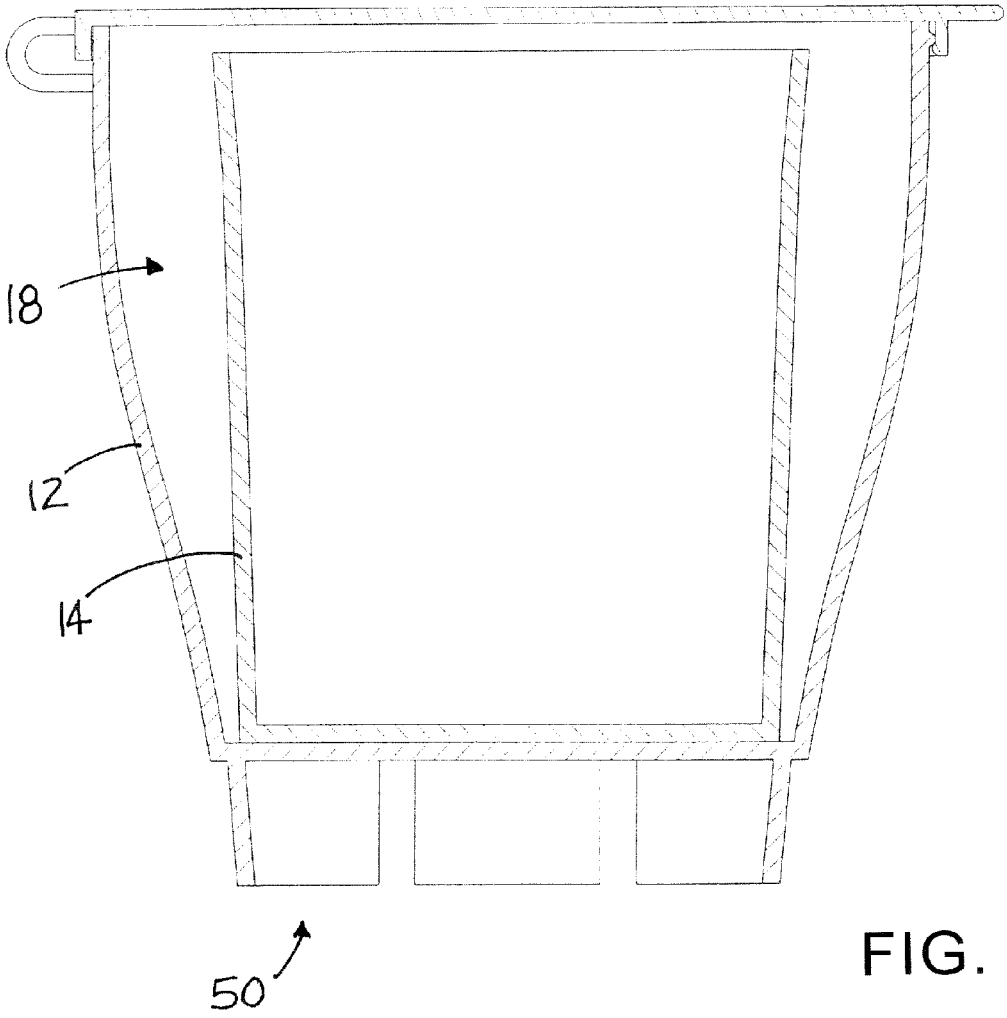
FIG. 6 is a schematic sectional view of the container system with the secondary container shown nested in the primary container.

With reference now to the drawings, and in particular to FIGS. 1 through 8 thereof, a new dispensing and disposing container system embodying the principles and concepts of the disclosed subject matter will be described.

The disclosure relates to a dispensing and disposing container system 10 that is highly suitable for holding an edible substance that may be consumed, and when consumed produces a waste product that needs to be held separate from the substance until the waste product can be disposed in a proper manner. For example, when sunflower seeds are provided in the shell for consumption, the seed and shell are typically placed in the mouth together where the seed and shell are separated, and the shell is ejected from the mouth while the seed is consumed.

In general, the container system 10 comprises a primary container 12 and a secondary container 14 that is removably mounted on the primary container. In greater detail, the primary container 12 has an upper opening 16 which opens into a primary compartment 18 that is defined by the primary container. The primary container 18 has a top 20 and a bottom 22, with the upper opening 16 being located at the top 20. The primary container 12 may comprise a primary perimeter wall 24 that surrounds the primary compartment 18. The upper edge of the primary perimeter wall may form the upper opening 16. The primary perimeter wall 24 may have a circular cross sectional shape, and in some embodiments the diameter of the primary perimeter wall is greater toward the top 20 and less toward the bottom 22. The primary container 12 may further include a primary base wall 26 that is positioned toward the bottom 22 of the primary compartment, and that forms a bottom of the primary compartment 18.

The primary container 12 may further include a lid 28 that is configured to removably close the upper opening 16 of the primary perimeter wall 24. The lid 28 may be connected to the primary perimeter wall 24 by a flexible connector 30, such as a living hinge or other extent of thin material that permits the lid to be moved toward and away from the upper opening. The lid 28 may comprise a top wall 32 that is configured to be able to cover the upper opening 16 of the primary container, and a perimeter lip 34 that extends along a perimeter of the top wall 32 and that has a diameter that permits the perimeter lip to extend about the upper portion of the primary perimeter wall adjacent to the upper opening 16 when the lid is engaged with the primary perimeter wall.

The secondary container 14 of the container system 10 may also include an upper opening 36 which opens into a secondary compartment 38. The secondary container 14 has a top 40 and a bottom 42. In some embodiments of the container system 10, the secondary container 14 is at least partially nestable in the primary compartment 18 of the primary container 12, and preferably the secondary container is fully nestable within the primary compartment of the primary container so that the lid 28 may be closed on the primary container when the secondary container is positioned therein, which is especially convenient for transport and storage of the container system 10 when not in use.

The secondary container 14 may include a secondary perimeter wall 44 that surrounds the secondary compartment 38. The secondary container 14 may also have a secondary base wall 48 located at the bottom 42 of the secondary container that forms the bottom boundary of the secondary compartment. The secondary perimeter wall 44 may have a substantially circular cross sectional shape, and the diameter of the perimeter wall 44 may taper smaller toward the bottom 42 and enlarge toward the top 40.

The container system 10 may further include a mounting structure 50 on the primary container 12 that removably mounts the primary container on the secondary container 14 in a first mounting mode and a second mounting mode. The first mounting mode (see FIGS. 3 and 4) are generally characterized by the primary container 12 closing the upper opening 16 of the secondary container and the secondary container supporting the primary container, so that, for example, the bottom of the secondary container may be rested upon a surface and the secondary container supports the primary container. Further, in the first mounting mode, the mounting structure 50 may be removably insertable into the upper opening 36 of the secondary container to hold the primary container 12 on the secondary container 14 in a manner such that the primary container substantially fully or completely closes the upper opening 36. The fit between the exterior of the mounting structure 50 and the inner surface of the secondary perimeter wall 44 may be snug enough that the two containers are held together by friction, but may be pulled apart by the application of some degree of separating force applied by the user's hands. Optionally, other means may be employed for holding the mounting structure 50 to the secondary perimeter wall 44 may be employed, but it is believed that the snug or even interference fit between the two elements provides a secure mounting with also being easy to manufacture and to clean. A shoulder 56 may be positioned radially outward from the mounting structure 50 to limit the penetration of the primary container into the compartment of the secondary container.

The second mounting mode (see FIG. 1) is generally characterized by the secondary compartment 38 of the secondary container 14 being accessible through the upper opening 36 of the secondary container while the primary container is supported on the secondary container. In the second mounting mode, the bottom 22 or primary base wall 26 is held in an offset orientation with respect to the upper opening 36 of the secondary container 14, so that a portion of the upper opening 36 is covered by the primary container but a portion of the upper opening 36 is not covered.

The mounting structure 50 may comprise a slot defining structure on the primary container 12 that defines at least two slots 52, 54, and each slot 52, 54 may be configured to removably receive a portion of the secondary perimeter wall 44 of the secondary container 14. In some embodiments of the device, the slot defining structure of the mounting structure 50 may comprise a plurality of fingers 58, 60 that extend downwardly from the primary container 12 with a slot 52, 54 being defined between adjacent fingers of the plurality of fingers. Each of the fingers 58, 60 may extend from the bottom 22 of the primary container. The slot-defining structure may comprise a wall extending from the bottom 22 of the primary container, and the wall may be substantially annular in shape, and portions of the wall may form the fingers and be substantially arcuate. While in the illustrative embodiments, each of the fingers 58, 60 is formed by a wall, it should be recognized that the invention is not so limited, and other elements with other shapes may form the fingers.

In some optional embodiments, the lid 28 may include a tab 62 that may be positioned substantially opposite of the flexible connection 30 on the lid and that may extend away from the lip 34 of the lid to provide a convenient grip area for the finger of the user to pull the lid open from the upper opening 16 of the primary container. Further, the exterior of the upper portion of the primary perimeter wall 24 may include a raised ridge 64 that may engage the interior surface of the perimeter lip 34 of the lid to help hold the lid in a closed position on the primary container.

Figure 7:
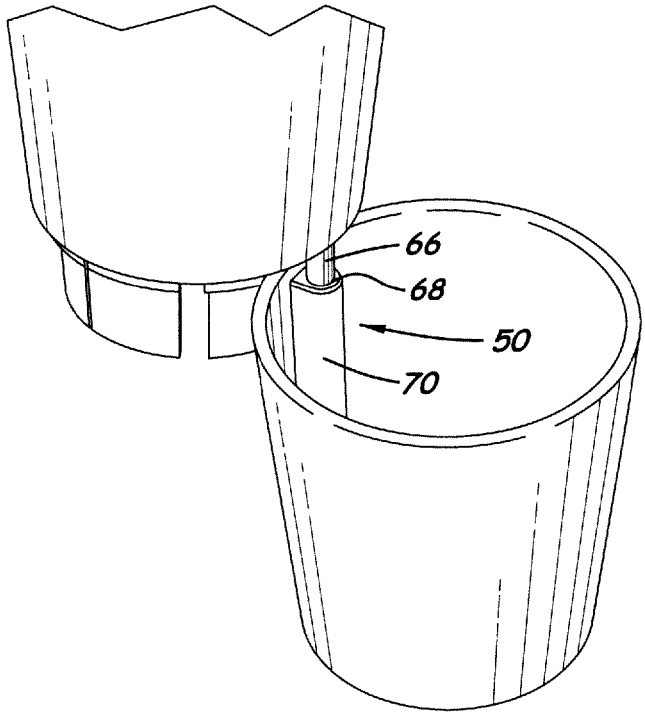
FIG. 7 is a schematic perspective view of the container system showing a variation of the mounting structure.
Figure 8:
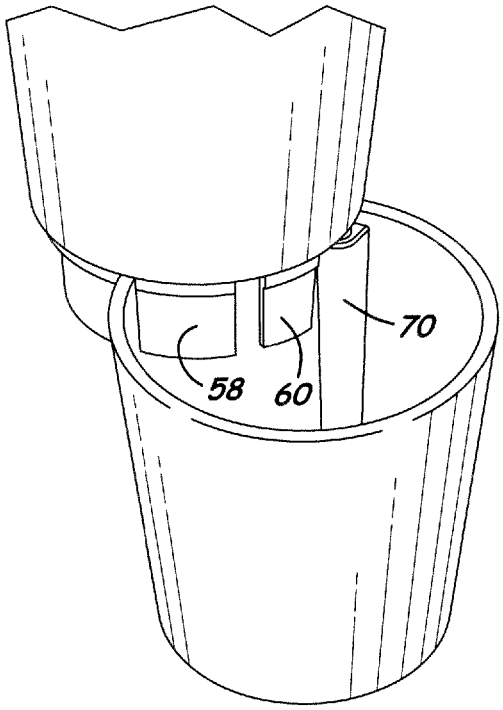
FIG. 8 is a schematic perspective view of the container system showing the variation of the mounting structure depicted in FIG. 7 in a different position.

A optional variation of the mounting structure 50 is shown in FIGS. 7 and 8 of the drawings, where the one of the fingers of the mounting structure comprises a substantially cylindrical pin 66 that is adapted to removably insert into a socket 68 formed on the secondary container, such as in the secondary compartment 38 and on the inner surface of the secondary perimeter wall 44. The socket 68 may be formed in a protrusion 70 formed on the inner surface of the secondary perimeter wall. FIGS. 7 and 8 show the primary container in different positions with respect to the secondary container, with only the pin 66 being located in the secondary compartment in FIG. 7, and the pin 66 as well as fingers 58 and 60 also in the secondary compartment. The pin and socket configuration of the mounting structure may provide additional security in mounting the containers together.

In use, the user of the container system 10 may open the lid 28 from the upper opening 16 of the primary container and fill the primary compartment with a supply of a foodstuff, such as sunflower seeds in the shell. If the user desires to store and/or transport the seeds before consuming them, then the lid may be closed if desired for convenient transport and the mounting structure 50 is poisoned in the upper opening 36 of the secondary container so that the mounting structure at least partially extends into the secondary compartment 38, and the bottom 22 of the primary container with the mounting structure fully closes the upper opening 36. When the user desires to consume some of the seeds, then the mounting structure 50 may be withdrawn from the secondary compartment and portions of the upper edge of the secondary perimeter wall 44 may be inserted into at least two of the slots 52, 54 of the mounting structure 50, so that the bottom of the primary container is held in an offset position with respect to the upper opening 36 of the secondary container, so that access to the secondary compartment is permitted even when the primary container is so mounted on the secondary container, and so that waste seed shells may be deposited in the secondary compartment without removing the primary container from the secondary container to do so. When the user finishes consuming seeds, the mounting structure 50 may be fully inserted into the upper opening 36 of the secondary container so that the upper opening 36 is closed by the bottom 22 of the primary container, thus containing the waste shells from falling out, while the seeds in shells in the primary compartment are protected from the waste shells. Of course, the secondary container may be removed from the mounting structure at any time and the shells dumped from the secondary compartment. Once the primary compartment 18 has been emptied of seeds, and the secondary compartment has been emptied of shells, then the secondary container 14 may be conveniently positioned in the primary compartment of the primary container, and the lid 28 closed upon the upper opening 16 so that the container system 10 may be conveniently and compactly stored and transported until further use.

Using the disclosed container system, a user can easily store a foodstuff such as sunflower seeds until he or she desires to consume them, the containers of the container system may then be repositioned with respect to each other to permit simultaneous access to the compartments of both of the containers, while the containers remain mounted together in such a way that the primary container is supported by the secondary container. This relationship permits the bottom of the secondary container to be positioned in a structure such as a cupholder in a vehicle so that the primary container is also held in the same cupholder while access is available to each compartment simultaneously. The compartments of the containers may be closed so that the contents of both containers remains held in the compartments during storage and transport.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A dispensing and disposing container system comprising:

a primary container having an upper opening and defining a primary compartment, the primary container having a top and a bottom;

a secondary container having an upper opening and defining a secondary compartment; and a mounting structure on the primary container that mounts the primary container on the secondary container in a first mounting mode and a second mounting mode, the first mounting mode being characterized by the primary container closing the upper opening of the secondary container and the secondary container supports the primary container, the second mounting mode being characterized by the secondary compartment of the secondary container being accessible through the upper opening of the secondary container while the primary container is supported on the secondary container;

wherein the containers are each in an upright position in the first mounting mode and the second mounting mode; and wherein the mounting structure extends downwardly from the bottom of the primary container to hold the primary container in a position at least partially over the upper opening of the secondary container in the second mounting mode.

2. The system of claim 1 wherein the mounting structure comprises a slot-defining structure on the primary container that defines at least two slots each configured to removably receive a portion of a secondary perimeter wall of the secondary container.

3. The system of claim 2 wherein the slot-defining structure comprises an annular wall extending from the bottom of the primary container, the at least two slots being formed in the annular wall.

4. The system of claim 2 wherein the slot-defining structure comprises a plurality of fingers extending from the bottom of the primary container.

5. The system of claim 1 wherein the mounting structure is removably insertable into the upper opening of the secondary container to hold the primary container on the secondary container in a manner such that the primary container substantially fully closes the upper opening of the secondary container.

6. The system of claim 1 wherein the secondary container is nestable in the primary compartment of the primary container.

7. The system of claim 1 wherein the secondary container is fully nestable within the primary compartment of the primary container.

8. The system of claim 1 wherein the primary container comprises a primary perimeter wall surrounding the primary compartment, and a primary base wall defining the bottom of the primary compartment.

9. The system of claim 1 wherein the primary container further comprises a lid configured to removably close the upper opening of the primary container.

10. The system of claim 1 wherein the secondary container comprises a secondary perimeter wall surrounding the secondary compartment and a secondary base wall defining a bottom of the secondary compartment.

11. The system of claim 1 wherein the primary container comprises a primary perimeter wall surrounding the primary compartment, and a primary base wall defining the bottom of the primary compartment;

wherein the secondary container comprises a secondary perimeter wall surrounding the secondary compartment and a secondary base wall defining a bottom of the secondary compartment;

wherein the mounting structure comprises a slot-defining structure on the primary container that defines at least two slots each configured to removably receive a portion of the secondary perimeter wall of the secondary container;

wherein the slot-defining structure comprises an annular wall extending from the bottom of the primary container, the at least two slots being formed in the annular wall;

wherein the mounting structure is removably insertable into the upper opening of the secondary container to hold the primary container on the secondary container in a manner such that the primary container substantially fully closes the upper opening of the secondary container;

wherein the secondary container is fully nestable within the primary compartment of the primary container; and wherein the primary container further comprises a lid configured to removably close the upper opening of the primary container.

12. The system of claim 1 wherein the bottom of the primary container is positioned above the top of the secondary container in the first mounting mode.

13. The system of claim 1 wherein, in at least one mounting mode of the first mounting mode and the second mounting mode, the primary container does not extend into the secondary compartment of the secondary container.

14. The system of claim 1 wherein, in both the first mounting mode and the second mounting mode, the primary container does not extend into the secondary compartment of the secondary container.

15. The system of claim 1 wherein the mounting structure comprises a slot-defining structure on the primary container that defines at least three slots, each slot being configured to removably receive a portion of a secondary perimeter wall of the secondary container, said slots being positioned on the primary container such that at least two mounting positions of the primary container with respect to the secondary container are defined in the second mounting mode.

16. The system of claim 1 wherein, in the first mounting mode of the mounting structure, the primary container is oriented such that the primary compartment of the primary container is capable of holding contents separately of the secondary compartment of the secondary container.

17. The system of claim 1 wherein, in the second mounting mode of the mounting structure, the primary container partially closes the upper opening of the secondary container while maintaining said access to the secondary compartment.

18. A dispensing and disposing container system comprising:

a primary container having an upper opening and defining a primary compartment, the primary container having a top and a bottom;

a secondary container having an upper opening and defining a secondary compartment; and a mounting structure on the primary container that mounts the primary container on the secondary container in a first mounting mode and a second mounting mode, the first mounting mode being characterized by the primary container closing the upper opening of the secondary container and the secondary container supports the primary container, the second mounting mode being characterized by the secondary compartment of the secondary container being accessible through the upper opening of the secondary container is maintained while the primary container is supported on the secondary container;

wherein the secondary container is at least partially nestable in the primary compartment of the primary container;

wherein the secondary container is fully nestable within the primary compartment of the primary container.

19. A dispensing and disposing container system comprising:

a primary container having an upper opening and defining a primary compartment, the primary container having a top and a bottom;

a secondary container having an upper opening and defining a secondary compartment; and a mounting structure on the primary container that mounts the primary container on the secondary container in a first mounting mode and a second mounting mode, the first mounting mode being characterized by the primary container closing the upper opening of the secondary container and the secondary container supports the primary container, the second mounting mode being characterized by the secondary compartment of the secondary container being accessible through the upper opening of the secondary container while the primary container is supported on the secondary container;

wherein the mounting structure extends downwardly from the bottom of the primary container to hold the primary container in a position at least partially over the upper opening of the secondary container in the first mounting mode and the second mounting mode;

wherein, in both the first mounting mode and the second mounting mode, the primary container does not extend into the secondary compartment of the secondary container;

wherein the mounting structure comprises a slot-defining structure on the primary container that defines at least three slots, each slot being configured to removably receive a portion of a secondary perimeter wall of the secondary container, said slots being positioned on the primary container such that at least two mounting positions of the primary container with respect to the secondary container are defined in the second mounting mode.

* * * * *